United States Patent [19]

Sheahan

[11] Patent Number: 4,723,109

[45] Date of Patent: Feb. 2, 1988

[54] HOLD DOWN DEVICE

[76] Inventor: James P. Sheahan, 5311 Bloomfield, Midland, Mich. 48640

[21] Appl. No.: 838,201

[22] Filed: Mar. 7, 1986

Related U.S. Application Data

[62] Division of Ser. No. 727,589, Apr. 26, 1985, abandoned.

[51] Int. Cl.[4] ..... E04D 1/00; E04D 13/00

[52] U.S. Cl. ..... 324/65 P; 52/173 R

[58] Field of Search ..... 52/173; 340/602–605; 324/65 R, 52, 54, 65 P

[56] References Cited

U.S. PATENT DOCUMENTS

| | | | |
|---|---|---|---|
| 1,477,766 | 12/1923 | Pulis | 249/215 |
| 3,238,835 | 3/1966 | Rosenberg | 52/404 |
| 3,383,863 | 5/1968 | Berry | 340/605 |
| 3,398,933 | 8/1968 | Haroldson | 52/126.5 |
| 4,110,945 | 9/1978 | Sheahan | 52/173 R |
| 4,166,244 | 8/1979 | Woods | 340/605 |
| 4,598,273 | 7/1986 | Bryan | 52/173 R |

FOREIGN PATENT DOCUMENTS

| | | | |
|---|---|---|---|
| 876117 | 8/1961 | United Kingdom | 52/126.6 |

*Primary Examiner*—Reinhard J. Eisenzopf
*Assistant Examiner*—Jose M. Solis
*Attorney, Agent, or Firm*—Robert L. McKellar

[57] ABSTRACT

A hold down device for multi-layered roofs. The hold down device can be modified to afford a water leak detector. A method of using the devices in securing a multi-layered roof is discussed.

7 Claims, 7 Drawing Figures

HOLD DOWN DEVICE

This is a division of co-pending application Ser. No. 727,589 filed on Apr. 26, 1985, now abandoned.

BACKGROUND OF THE INVENTION

This invention deals with a hold down device for multiple layered roofs, a device for detecting leaks in a roof, and a method of detecting leaks in a roof.

More specifically, there is provided a means for holding a multiple layered roof in a secure manner, with the additional benefit that the hold down devices utilized for such a purpose are adapted to function as water leak detectors.

Large industrial and commercial buildings quite typically have flat or near flat roof surfaces. These roof surfaces generally are multi-layered, that is they generally have in combination a roof supporting structure which is surmounted by a deck, and various layers of water impermeable membranes, thermal insulation and a ballast layer to assist in holding the entire roof from being blown away.

These types of roofs tend to be economical and function quite well as long as there is no break in the water-impermeable membrane. Once the water-impermeable membrane is broken, water enters the roof deck and seeps and runs and eventually enters the interior of the building. When this happens, the roof must be repaired, but often one cannot detect where the membrane is broken and hence cannot effectively undertake repairs.

A second problem with the multiple layered roof is the inability of modern science to devise a scheme for holding the roofs in place, especially during violent storms accompanied by high winds. Current acceptable methods for holding down roofs are to cover the multiple layers with gravel or stone, point attachment, or a combination of both. This obviously tends to hold the roof down but such ballast contributes to the weight of the roof and requires strong structural support which results in higher costs for installation of such a roof.

It would be desirable to have a system for holding down roofs that would have the benefit of lowering the costs of the installation of such roofs. It would be a further benefit if the system used to hold down the roof could act as a more or less permanent system to detect leaks in the roof.

Several systems are currently in use for detecting leaks in a roof, for example, Gustafson, in U.S. Pat. No. 3,824,460, issued July 16, 1974, discloses a leakage sensor strip which is a pair of encased wires held essentially parallel to each other by a plurality of spaced webs which are an extension of the casing of the wires. The sensor strip is placed and held flat on a floor or roof deck over a certain length so that leakage anywhere along the probe will result in a capacitance change which can be sensed. It is important to note that this system does not provide a hold down function and furthermore, this sensor strip requires a metal channel over its full length in order to hold it flat on the surface. This feature renders the method of installing very expensive and time consuming.

Another patent, U.S. Pat. No. 3,967,197, discloses a method of detecting moisture in a multilayered roof system. The method disclosed consists of reading the capacitance at various predetermined points on a roof surface to create a base line reading and then periodically re-reading the capacitance at these same points to determine a deviation from the original reading. A capacitance meter is moved over the surface of the roof. Wherever the moisture in the roof has increased, the dielectric constant increases and the expectation is that this is indicative of a water leak.

A third system that has been used for detecting water leaks in a roof is that disclosed in U.S. Pat. No. 4,110,945, issued Sept. 5, 1978. In that method, a plurality of water detectors are positioned under the water-impermeable membrane of a roof. In the event that the water-impermeable membrane is broken and the roof leaks, the general area of the leak can be determined. Each such water detector is electrically powered and connected to a sensor at a location remote from the roof.

It should be noted that there is no hold down function in either the latter two systems and further, it should be noted that if the system of U.S. Pat. No. 4,110,945 requires repair, it may be required to remove and replace a fair section of the roof.

In spite of the usefulness of the above noted systems, there is still a need for a device for conveniently holding down roofs, and a need for a simpler, more dependable means of detecting roof leaks.

SUMMARY OF THE INVENTION

The present invention deals with solutions to the problems of securing a roof in place and the inability to quickly and accurately determine the location of roof leaks. The instant invention therefore comprises a hold down device, a modified hold down device for use in detecting water leaks in a roof, and a method of securing a roof in place as well as a method for detecting leaks in a roof.

Thus, the present invention deals with a hold down device consisting of two joinable pieces. The device is designed such that the bottom half of the device is securely attached to a roof deck over the water-impermeable membrane and after the multiple layers of the roof are installed, the top half of the device is operably joined with the bottom half and tightened down such that the top plate of the top half compresses the top layer of the multiple layer roof and holds the top layer and all intervening layers to the roof deck. The result is a novel hold down device which has penetrated through but has not destroyed the water-impermeable membrane and has provided secure anchoring for the roof layers.

This device can be modified in order to enable the easy detection of roof leaks. This is accomplished by providing electrical leads in the bottom plate where it is anchored to the roof deck. The leads pierce the water-impermeable membrane and enter the roof deck but the bottom plate is compressed over the penetrations made by the leads and acts as a seal on the penetrations when the plate is securely fastened to the roof deck. The electrical leads are continued through the internal stems of the device and terminate in electrical contact points. The top half of the device is similarly constructed so that the two halves, when joined, provide electrical contact points at the upper surface of the roof that can be used to ascertain water leakage in the roof.

When such devices are used in combination to secure a roof, they provide a regularly spaced layout of such devices that one can use to determine the exact location of a water leak in the roof.

DESCRIPTION OF THE PREFERRED EMBODIMENTS

Figure 1:
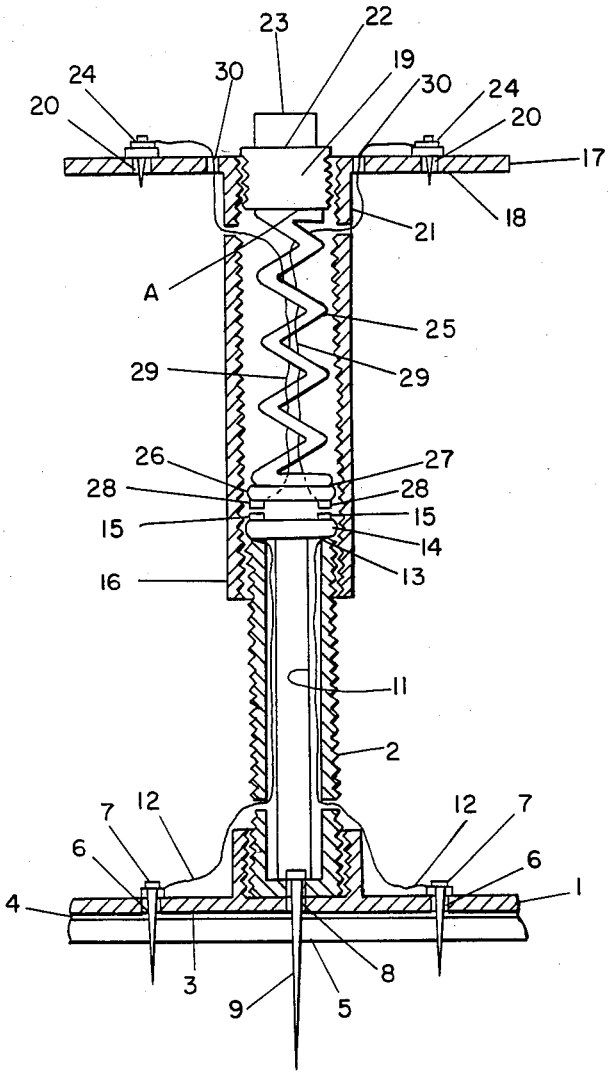
FIG. 1 is a sectioned view of the hold down device which is a vertical section at the center point of the device.

Referring now to the drawings in which like-numbers indicate like-parts or pieces, there is shown in FIG. 1 a hold down device of this invention which is comprised of an enlarged flanged base 1 and a hollow, first adjustable nesting stem 2 which is shown herein as being threaded. The flange is essentially flat on the bottom 3 which rests on the water-impermeable membrane 4 which in turn covers the roof deck 5 in a roof structure. The flat flange contains two aperatures 6 which are receptacles for electrical leads 7, the leads 7 are designed so that they are detachedly secured in the aperatures 6 and such that they extend through the aperatures 6 and pierce the water-impermeable-membrane 4 and the roof deck 5, when the device is in place. The flange 1, which can be fabricated from metals, metal alloys or plastics, has a small center bore 8 through which passes a mechanical fastener 9, the fastener being the principle means by which the device is secured to the roof deck 5. Many types of conventional fasteners can be used.

As can be noted from FIG. 1, the enlarged flanged base is integrally surmounted by a hub 10 which is internally threaded to receive the hollow, threaded, first nesting stem 2. This hollow nesting stem contains an inner wall 11 which restrains electrical conduits 12 when they are used in the device. The inner wall 11 can be fashioned from plastic or cardboard or any lightweight material as its only function is to restrain the electrical conduits 12.

The uppermost edge 13 of the first nesting stem 2 is surmounted by an electrical insulating layer 14 of an electrical insulating material. The electrical insulated layer 14 is surmounted by at least two metal electrical, semi-circular contacts 15 and each such contact has attached to it an electrical conduit 12, which it will be noted furnishes an electrical connection between the metal leads 7 and the metal contacts 15, the electrical conduits 12 beginning at the electrical leads 7, ascending through the hollow of the first nesting stem 2 and terminating at the metal contacts 15.

A second, hollow nesting stem 16 is operably associated with the first nesting stem, in this case by mating threads. The second nesting stem 16 is integrally surmounted by an enlarged flanged top 17, comprising a top plate 18 having a centrally located bore 19 and two aperatures 10 therethrough. The top plate 18 has a centrally located hub 21 which has a center bore therethrough to receive and detachedly secure the second nesting stem 16.

The top plate 18 contains in its center bore, a removable tightening plug 22 which has a protrusion 23 extending above the top plate 18 in order that the device can be adjusted up or down by turning the plug 22.

The two aperatures 20 have electrical leads 24 removably inserted in them. A compression spring 25 is removably mounted on the plug 22 at the bottom of the plug at(A). The compression spring 25 extends through the hollow to the end of the second nesting stem 16.

The end of the compression spring 25 that is distal from its attachment to the plug 22, has an insulating layer 26 of an electrical insulating material attached to the edge 27 thereof. Surmounted on the layer 26, are at least two metal point contacts 28. Attached to each metal point contact 28 is an electrical conduit 29, the electrical conduits 29 ascending through the hollow of the second nesting stem 16 and passing through aperatures 30 and each connecting to and terminating at the electrical leads 24.

When the first nesting stem 2 and the second nesting stem 16 are joined, the second nesting stem 2 is turned down on the first nesting stem 16 and the metal contacts 15 intimately touch metal contacts 28 thus completing the conduit from metal leads 7 to metal leads 24. The compression spring 25 ensures that this contact is maintained.

In use, a roof structure is provided with a roof deck and a water impermeable membrane is laid down over the roof deck. The roof deck and membrane can be premeasured and premarked for installation points at which the devices of this invention are secured but it is normal practice to install the roof piecemeal after the water-impermeable membrane is laid down and therefore, the size of the thermal insulation planking or the size of planking on the top most layer can determine the installation points of the device since the device is designed to be installed where the four corners of the top planks intersect so that the top plate 18 of the device can grip the corners of the top most planks and hold them down or, the devices can be installed such that the device holds down the center of the top planks.

By whatever procedure desired, the enlarged flange base 1 containing the first nesting stem 2 and the hub 10 integrally secured thereto, is first securely fastened to the roof deck, over top the water-impermeable membrane, using a mechanical fastener such as a bolt, screw or nail inserted through the center bore 8. During this installation, the metal leads 7 pierce the water-impermeable membrane but as soon as the mechanical fastener draws the enlarged flange base tightly to the roof deck, the penetrations made by the leads are sealed by the flange and the water-impermeable membrane remains intact.

Next, the roof is installed except for the ballast layer and as the top planking of the roof is installed, the top half of each device is engaged with the bottom half of each device and the top half is turned down until the top plank of the roof is securely fastened. In the process of turning the top half of the device down, it will be remembered that the metal contacts of the two pieces contact each other. As the top half of the device is turned down to secure the top planks, the compression spring is compressed in the hollow of the second nesting stem, thereby not requiring any further adjustments in the device to ensure that the contacts are meeting. Finally, the ballast layer is applied to the roof. Rigid thermal planks are often the final layer.

Obviously, the flanges and stems which make up this device, and which contain the electrical accoutrements, are easiest prepared in the workshop prior to their use on the roof, although it is possible to prepare them on the job site if it is required.

When prepared in the workshop, the flanges and lower parts of the stems are dipped in a curable elastomeric compound to maintain them erosion and moisture free while in use.

Figure 2:
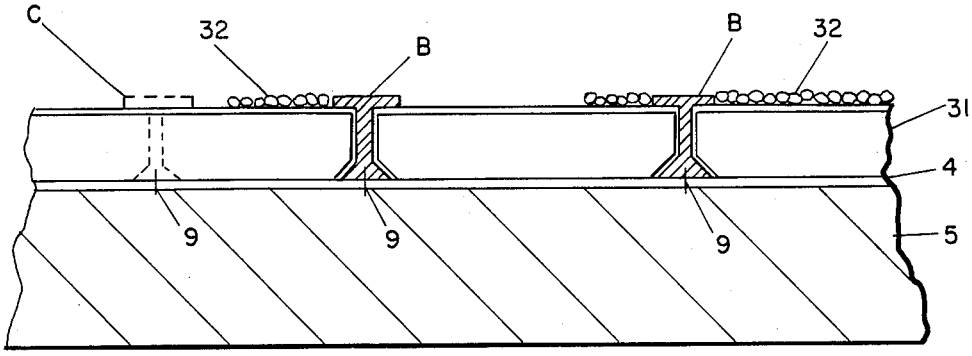
FIG. 2 is a schematic sectional view of a portion of a roof showing the placement of some devices of this invention.

FIG. 2 shows schematically the typical placement of the devices in a roof system. The roof deck 5 is shown as the bottom most layer of the multi-layered roof. The roof deck 5 is topped by the water-impermeable membrane 4 and three devices labelled (B) are affixed over the water-impermeable membrane using a mechanical fastener 9. One device (c) is shown in phantom in the center of the thin concrete layer. A foamed thermal insulation layer 31 is then placed on top and the whole is surmounted by a light layer of ballast 32, such as crushed stone or thin concrete. If the device requires repair at any time, the ballast layer or thin concrete is removed only from the device to be repaired, the top half of the device is removed and the bottom half unsecured from the roof deck. The reverse order is used when replacing the device.

Figure 3:
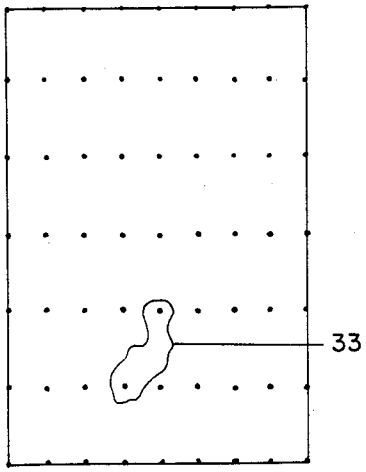
FIG. 3 is a top view of a roof showing the regular placement of the devices to hold down the roof.

As depicted in FIG. 3, there is shown a top view of a roof wherein the dots represent the devices of this invention. The roof is depicted without the ballast layer for purposes of explaining the method of the invention. Letters have been used along the vertical axis and number along the horizontal axis in order to more fully explain the method of this invention.

The amorphous spot 33, in the middle of the diagram is intended to be water over a small break in the water-impermeable membrane which is not visible by a visual inspection of the roof surface. In order to detect this leak, one locates the devices of this invention and scrapes away the light ballast layer. The two metal leads on the surface of the device, say, for example, at point B4, are contacted by piercing the elastomeric coating over the metal lead with sharp metal probes which are attached to a sensor instrument. With each surface probe so located, readings of the dielectric constant are taken of the device, which in fact are readings of the two metal leads that form part of the flanged base and that have pierced the roof deck upon construction. Several readings taken at points B3, B4, B5, C4, C5 and C6 clearly indicate that there is water at B4 and C5 and none at B3, B5, C4 and C6, therefore indicating that the break in the membrane is in that nearby area. This area is then subjected to repair.

The devices of this invention can be manufactured from metal, metal alloys or plastics. Preferred are lightweight, touch plastics since they can be filled to enhance their strength. Such plastics can be for example, olefinic polymers such as polyethylene and polypropylene; polyvinylchloride; urethanes and nylon. Preferred are nylons and most preferred are filled nylons.

Figure 4:
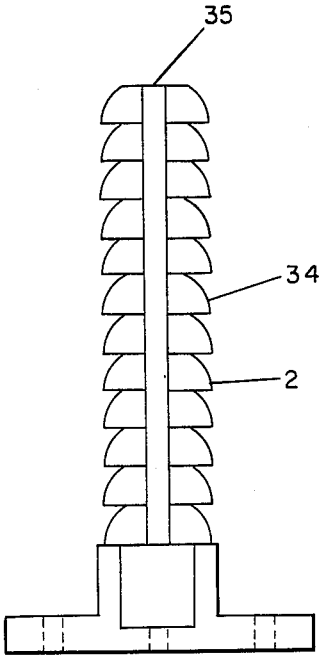
FIG. 4 is a side plan view of one version of an alternate adjusting and locking mechanism for the device (upper piece).

The drawings and examples herein show mated threads to couple the device together but it is contemplated within the scope of this invention that other means can be used to adjust and couple the two pieces of the device. For example, FIGS. 4 and 5 show a device which is useful herein for that purpose.

Instead of threads, the first nesting stem 2 is composed of a stem whose surface is scrolled in regular layers so that there is formed compressable fins 34. The fins do not travel around the entire outer circumference of the stem but are interrupted at one or two places. The interuptions serve as smooth channels 35 for the movement of the teeth 36, shown in phantom on the interior surface of the second nesting stem 16, of FIG. 6.

Figure 5:
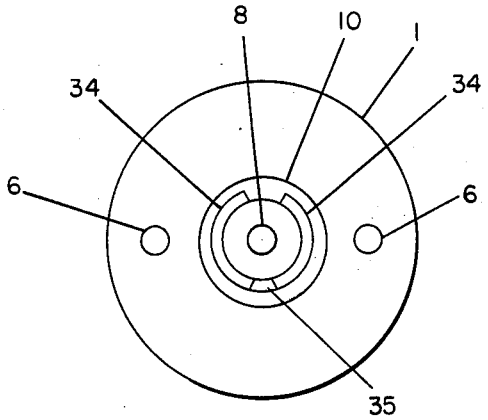
FIG. 5 is a top plan view of the device of FIG. 4.
Figure 6:
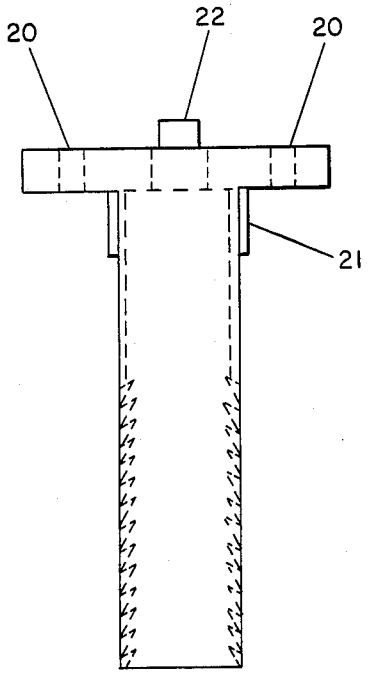
FIG. 6 is a side plan view of one version of an alternate adjusting and locking mechanism for the device (lower piece).

FIG. 5 is a top plan view of the bottom half of the device and shows the enlarged flanged base 1, containing aperatures 6 and 8; hub 10; smooth channel 35 and compressable fins 34. FIG. 6 shows the upper half of the device with the aperatures 20 and the plug 22 in place. Vertical rows of shark-line teeth 36 are performed in the interior wall of the hollow stem.

Figure 7:
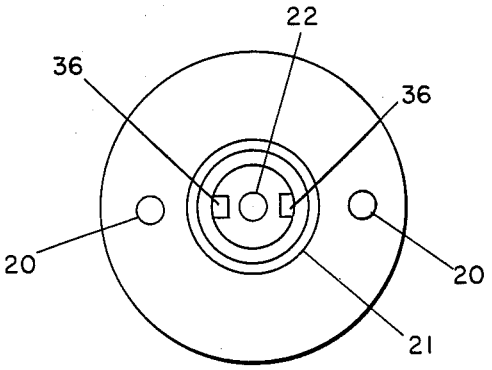
FIG. 7 is a bottom plan view of the device of FIG. 6.

FIG. 7 shows a bottom plan view of the top half of the device. Shown there is the bottom of the plug 22; the vertical rows of shark-like teeth 36; the aperatures 20 and the hub 21.

In use, the stem of the top of the device is fitted to the stem of the bottom half of device such that the shark-like teeth 36 are not aligned with the smooth channels 35 and the top half is forced down onto the bottom half whereupon the shark-like teeth 36 lock into the fins 24 and the device cannot be separated because of the ratchet lock of the shark-like teeth 36 in the fins 34.

To remove the top half of the device, the top half is forced down slightly, the top half turned until the shark-like teeth 36 match the smooth channels 35 and the top half is withdrawn as the teeth move easily up the smooth channel.

The elastomeric material used to coat the ends of the device and prevent erosion can be any elastomeric material. Such materials are organic rubbers, silicone rubbers and silicone-modified organic rubbers.

That which is claimed is:

1. A hold down and leak detector device for securing multiple layered roof structures and detecting water leaks in a roof, the device comprising, in combination:

an enlarged flanged base, said flanged base comprising a bottom plate having a centered aperture extending therethrough, said bottom plate having at least two additional apertures therethrough and located other than at the center of the bottom plate; said bottom plate being integrally attached to and surmounted by a centrally located hub which hub has a center bore extending to the upper surface of the bottom plate;

said hub being capable of receiving and securing a detachable, adjustable, hollow first nesting stem, said first nesting stem extending vertically therefrom;

said first nesting stem having its upper edge surmounted by an electrical insulating layer of an electrical insulating material, said layer surmounted by at least two electrical semi-circular contacts, each electrical semi-circular contact having attached thereto an electrical first nesting stem conducting conduit;

each said first nesting conducting conduit descending through the hollow of the first nesting stem and exiting through an aperture located in the wall of the first nesting stem;

each electrical first nesting stem conduit connecting to and terminating at its own conductive lead, each conductive lead being positioned and detachedly fixed in one of the additional apertures of the base plate such that the conductive leads will extend through the aperture and pierce a roof membrane secured to a roof structure;

a second hollow nesting stem which is operably associated with the first nesting stem, said second nesting stem having an enlarged flanged top mounted on its upper end;

said enlarged flanged top comprised a top plate having at least two additional apertures therethrough and located other than at the center of the top plate;

said top plate being integrally attached to and surmounted on a centrally located second hub, which second hub has a center bore therethrough, said second hub being capable of receiving and detachably securing the second nesting stem at the end opposite its contact with the first nesting stem;

said enlarged flanged top plate containing a tightening plug, surmounted by a tightening protrusion, removably located in the central bore;

said tightening plug having removably mounted on its under surface a compression spring, said compression spring having a total length approximating the length of the second nesting stem;

the compression spring having mounted on its edge, distal from its attachment to the tightening plug, an electrical insulating second layer of an electrical insulating material, said second layer surmounted by at least two metal electrical point contacts, each electrical point contact having attached thereto, an electrical conducting conduit, each said conduit ascending through the hollow of the second nesting stem and exiting through an aperture located in the wall of the second nesting stem;

each electrical second nesting stem conduit connecting to and terminating at its own conductive lead, each conductive lead being positioned and detachably fixed on one of the additional apertures of the top that the conductive leads are exposed to the atmosphere;

said first nesting stem and said second nesting stem being adjusted relative to one another such that when the enlarged flanged base is secured to a multiple layered roof structure, the point contacts of the second nesting stem and the semi-circular contacts of the first nesting stem are capable of intimately contacting each other.

2. The device of claim 1 wherein the nesting stems are adjustable by means of mated threads.

3. The device of claim 1 wherein the nesting stems are adjustable by means of a ratchet.

4. The device of claim 1 when primarily manufactured using metal.

5. The device of claim 1 when primarily manufactured using plastics.

6. The device of claim 5 wherein the plastic is nylon.

7. The device of claim 6 wherein the nylon is filled nylon.

* * * * *